US005713169A

United States Patent [19]

Meier et al.

[11] Patent Number: 5,713,169

[45] Date of Patent: Feb. 3, 1998

[54] ANCHORAGE DEVICE FOR HIGH-PERFORMANCE FIBER COMPOSITE CABLES

[75] Inventors: Urs Meier, Schwerzenbach; Heinz Meier, Bassersdorf; Patrick Kim, Saint-Prex, all of Switzerland

[73] Assignee: Eidgenossische Materialprüfungsund Forschungsanstalt EMPA, Dübendorf, Switzerland

[21] Appl. No.: 564,247

[22] PCT Filed: Apr. 13, 1995

[86] PCT No.: PCT/CH95/00080

§ 371 Date: Mar. 19, 1996

§ 102(e) Date: Mar. 19, 1996

[87] PCT Pub. No.: WO95/29308

PCT Pub. Date: Nov. 2, 1995

[30] Foreign Application Priority Data

Apr. 25, 1994 [CH] Switzerland ..... 1270/94

[51] Int. Cl.[6] ..... E04C 5/12

[52] U.S. Cl. ..... 52/223.13; 52/745.19; 52/745.2; 403/371; 403/374

[58] Field of Search ..... 403/371, 374; 52/223.13, 745.19, 745.2; 29/897

[56] References Cited

U.S. PATENT DOCUMENTS

| | | | |
|---|---|---|---|
| 4,662,134 | 5/1987 | Illgner | 52/223.13 |
| 4,744,691 | 5/1988 | Thal | 52/223.13 X |

FOREIGN PATENT DOCUMENTS

| | | | |
|---|---|---|---|
| 428304 | 5/1991 | European Pat. Off. | 52/223.13 |
| 8600369 | 9/1987 | Netherlands | 52/223.13 |

*Primary Examiner*—Christopher Kent
*Attorney, Agent, or Firm*—Breiner & Breiner

[57] ABSTRACT

A conical anchoring system to anchor one or more loaded, stressed or pre-stressed tension elements (9) comprising a conical anchoring casing and an anchor body (7) fitting into the casing and retaining the tension element(s). The boundary surface between the anchor body and the casing wall is substantially designed to allow free sliding. To prevent the tension elements from being torn out of the anchor body or rupturing the anchor body itself, the rigidity of the gradient material forming the anchor body increases from the site of entry of the tension element at the cone, that is from the front zone, to the rear part of the anchor cone. Substantially improved shear distribution along the surface of the tension element(s) is achieved thereby over the case of substantially uniform rigidity of the anchor body.

14 Claims, 3 Drawing Sheets

ANCHORAGE DEVICE FOR HIGH-PERFORMANCE FIBER COMPOSITE CABLES

FIELD OF INVENTION

The present invention concerns a conical anchoring system for one or more loaded, stressed or pre-stressed tension element(s), such as construction ties, which comprise at least one conical anchor casing and an anchor body fitting into a sleeve and holding the tension element(s), the body evincing a surface essentially freely sliding along the casing wall. Further, the invention concerns a method for manufacturing a conical anchoring system and a method for cladding/coating filler particles used in an anchoring system.

BACKGROUND OF THE INVENTION

The Swiss construction industry has assumed since the 1950's an outstanding position in the field of pre-stressed engineering. Within this field in the late 60's, the special branch of parallel cable or stranded cables for braced construction was developed. Pioneering examples are the cable bridge at Mannheim-Ludwigshafen and the Olympic roof at Munich. Aerospace developments in carbon-reinforced plastics in recent years made it plain that the use of parallel cable bundles with carbon-fiber cables should be considered in the field of construction. In particular, appropriate replacement of the heavy, corrosion-susceptible steel cables in pre-stressed or braced construction suggested itself. The requirements set, for instance, on cable bridges that the cables be in the form of a lightweight, rigid, corrosion-resistant and long-term stable material with high fatigue resistance lead to carbon-fiber reinforced epoxy resins. Fiber-composite materials are highly advantageous because of combining high strength and low bulk-density, while simultaneously eliminating the corrodibility of steel cables.

The basic problem is to reliably anchor carbon-fiber reinforced tension bars replacing steel cables in construction involving bracing wires and cables in such manner that the high static strengths and fatigue resistances can be exploited optimally. Rupture in tension tests should take place not in the anchoring but along a free site. In principle, therefore, this is a linkage problem, namely the problem between the cable and the anchoring, more specifically regarding the conventionally selected conical anchorings at the linkage of the cable and anchor body.

In recent years, research and development has been applied to the anchoring of composite tension elements. Much of this work has concentrated on fiberglass-reinforced tension bars and aramide strands, and is discussed for instance in the literature of Mitchell et al, 1974; Kepp, 1985; Walton & Jeung, 1986; Burgoyne, 1988; and Dreessen, 1988. However, glass and aramide composites offer too low a rigidity for main support structures, and carbon-fiber reinforced materials must then be used. Some work has been carried out on carbon-fiber reinforced tension members, for instance by Walton & Yeung, 1986, and Yeung & Parker, 1987. However, the test results seem short of the success required for reliable and large-scale application in construction.

The main goals in designing an anchoring system are to achieve the most advantageous stress distribution, and, as regards the tension tests, to shift the cable ruptures to unencumbered sites and to reduce the anchoring system's tendency to creep. Basically, extant anchoring systems can be divided into three categories: clamped anchoring, bonded anchoring and conical anchoring. Steel cables and fiberglass bars can be anchored by means of all three, compression sleeves for smaller tension elements being more frequently used in practice, whereas cast anchors are mostly used for larger cables. As a rule, conical cast anchoring systems have been preferred for the carbon-fiber reinforced bars and cable.

BRIEF DESCRIPTION OF THE INVENTION

Essentially the anchoring system is composed of four parts:

1. The anchor casing, which is connected to the structure by rests or screw threads;
2. The tension member(s) to be anchored;
3. The anchor body assuring force transmission from the cable to the anchor casing;
4. The slide film between the anchor casing and the anchor body.

In general, the anchor casing is made of steel. However, it can also be made of a fiber composite or be in the form of a steel anchor casing reinforced with fiber composites. The casing also serves as a mold for making the anchor body. The anchoring body per se is a critical part of the system. It must provide a good connection with the tension element in order too fully transmit the introduced force to the anchor casing. Stress tests as a rule show that the first damage will be in the front anchor zone. "Front" herein denotes that part of the anchor at which the tension element exits the anchor in the direction of the unencumbered segment. Illustratively, if there is insufficient linkage between the tension element and the anchor body, continuous cracks along the cable surface or inside it are formed, which may cause ruptures at the boundary layer between the cable and the anchor body causing so-called wire slippage. If there is wire slippage, the initial cracks at the front anchor part propagate along the full cable length. In addition to the sheared rupture surfaces, tensile rupture also has been observed which, in the anchor body, run perpendicularly to the tension element(s) as indicated in FIG. 1 of the attached drawing.

The object of the present invention is the anchoring of slender, cable-like tension elements in a conical anchoring system whereby ruptures of the slender tension elements, such as cables, shall occur only within the free segment, not in the anchoring system itself. This problem is solved by the invention by a conical anchoring system, in particular, as defined in claim 1.

Research on anchoring systems shows in the case of constant system rigidity over the full anchoring length that the major part of the tension will be received at the front of the anchor. This is reflected by a sharp stress peak in the shear profile as shown in FIG. 2 of the drawing below. Accordingly, in order to achieve more uniform stress distribution, the anchor body must evince varying rigidity, the rigidity being very low at the anchor front and increasing toward its rear. In the manner proposed by the invention, the variation in rigidity can be controlled in a number of ways, in particular by

- variation of the rigidity (Young's modulus) of the anchor-body material;
- tapering the anchor cone forward, that is where the cable enters the anchor, and
- varying the rigidity of the anchor casing.

Obviously, the three suggested design steps also may be combined.

Accordingly, a conical cast anchoring system is proposed by the invention to anchor one or more loaded, stressed or pre-stressed tension element(s) and comprises a conical anchor casing and an anchor body fitting into the casing and retaining the tension element(s), the body evincing an essentially freely sliding surface opposite the casing wall. The anchor body is characterized in that its rigidity increases from the cone entry of the tension element(s), that is from the front to the rear.

Shear distribution as uniform as possible over the length of the anchor can thereby be achieved when anchoring the slender tension element(s), i.e. the cable(s). The ideal shear distribution is free of pronounced peaks or gradients and drops toward zero near the free, unloaded tension element (s).

The anchor bodies for parallel cables or parallel bundles of cables can be made from many different materials, but preferably the anchor fillers are composed of a binder matrix, in particular a plastic resin and at least one filler. The above proposed varying rigidity of the anchor body of the invention results from different filling degrees, different filler geometries and/or different rigidity, i.e. hardness of the filler. However, the varying rigidity also can be achieved through the binder matrix in that, for instance, a substantially pressure-setting plastics polymer system such as a synthetic resin is filled with plasticizers, flexibilizers, softeners and/or elastomer blocks incorporated into the polymer present in increased proportions at the front of the anchor cone.

Practical considerations exclude metal castings or metal clamps when using carbon-fiber cables because both anchoring systems would damage the cables on one hand by the heat of the casting alloys and on the other hand by the high, and sometimes other than, radial transverse pressure. In this respect, a plastic anchoring system preferably is used, and, in particular, epoxy resin systems, polyurethane resins, and also thermoplastics such as polyether ketones, polysulfones, polycarbonates or polymethylmethacrylate already have been found advantageous. The advantage of epoxy resin systems is that the resin system already lowers the strength on account of the use of flexibilizers, plasticizers, etc., whereas on the other hand the use of highly cross-linked epoxy resin systems allows achieving very high strengths.

It was found practically useful that the rigidity of the anchor body of a cast anchoring system vary from front to rear by a factor in the approximate range of 20 to 300, preferably by a factor of about 80 to 100.

Again, it was found advantageous that the anchor cone be of a minimal angle, namely of about 5° to 15°. In other words, a slender cone results in a more advantageous stressed state. The lower angle of the angle of aperture is set by the maximally admissible cone slippage, that is the maximum shifting under load. If the cone angle is too small, there will be danger either of tearing-out the full anchor body or of rupture in the anchor casing.

Another factor in controlling the area of shears is to select the radius of the anchor aperture when engaging the tension element. The invention proposes for that purpose that the difference in the radii of anchor aperture and of tension element or tension-element bundle when said element(s) is/are engaged shall assume a magnitude of about 0.5 to 15 mm.

The applicable advantageous tension elements in particular are cables consisting of carbon-reinforced epoxy resin. Such carbon fiber cables can be manufactured by the so-called continuous method, i.e., pultrusion. This procedure is well known in the state of the art and, therefore, further description of the manufacture of carbon-fiber reinforced cables can be dispensed with herein. However, in lieu of the epoxy-resin matrix, a thermoplastic matrix also can be used, for instance with polyether ketone.

Appropriate fillers in the anchor body obviously are any fillers used for polymers, in particular steel, quartz, glass, rubber and/or preferably aluminum oxide, in the form of scrap, sand, balls, fibers, granulates and the like. Depending on the filler used and the quantity used, it is possible to substantially control the strength and rigidity in the anchor body, for instance pure epoxy resin evincing a Young's modulus in the approximate range of 500 to 4,000 MPa whereas values exceeding 100,000 MPa can be reached using steel scrap or aluminum oxide.

It was found advantageous in practice that the anchor body evince at least two zones of different rigidities in the anchor cone, preferably however about three to five zones. The rigidity values of the different zones must increase from the front to the rear areas of the anchor cone. The ideal case of course would be that the rigidity monotonely increase from front to rear, but in practice such a design would entail increased cost/complexity. Moreover, the selection of three to five zones offers adequate spreading of shearing, as again shown by the following examples and figures.

Also, a method for manufacturing a conical anchoring system of the invention is proposed in the manner defined in claim 10. It was found to be problematical to fill the filler into the cone during casting in such a way that a minimum of three to five zones of different rigidity are implemented. For instance, if a very fine filler is used, then the filler distribution in the comparatively soft front zone will be poor, but if a coarse, i.e., a large-volume filler is used, a soft zone hardly can be made. Accordingly, the invention further proposes that the filler be clad/coated in different degrees with binders before the anchor filler material is filled-in. Thereupon, strongly clad/coated filler together with the binder will be filled at the front zone of the anchor cone into the anchor casing/cavity, whereas in the rear zone, a filler only slightly clad/coated or not at all will be used. Illustratively, the filler can be coated by means a fluid-bed coater. The shrinkage of the anchor body in the front part furthermore can be much reduced by this procedure.

In a variation of the method of the invention, it was found advantageous to carry out the filler fluid-bed coating procedure in a so-called fluid-bed granulator or in an agitator-mixer or biaxial mixer, for instance aluminum oxide particles being clad in or coated with an epoxy-resin system.

BRIEF DESCRIPTION OF THE DRAWINGS

The invention is elucidated below in an illustrative manner and in relation to the attached figures.

DETAILED DESCRIPTION OF THE PRESENTLY PREFERRED EMBODIMENTS

Figure 1A:
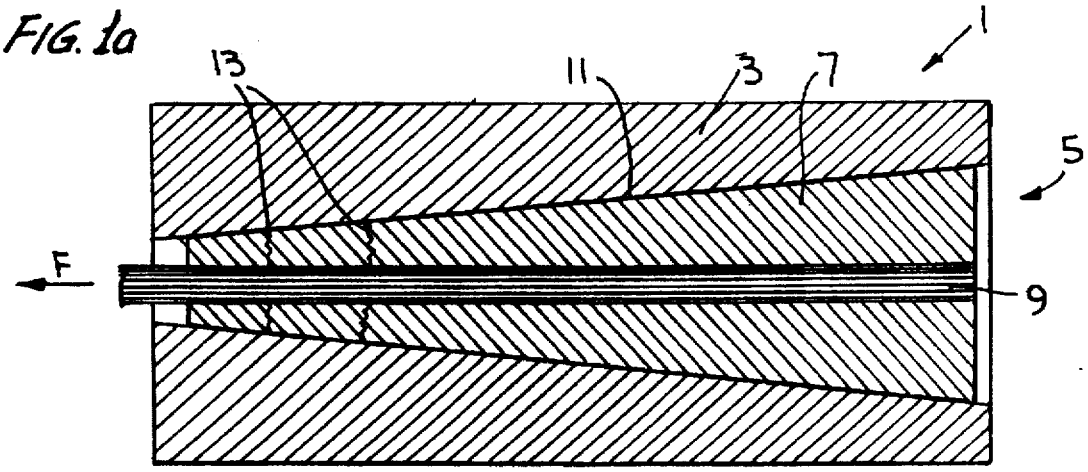
FIG. 1*a* schematically shows a section of an anchor cone in an anchor body with tensile cracks perpendicular to the tension elements. The cracks are shown the way they typically occur if the rigidity is inadequately graduated.
Figure 1B:
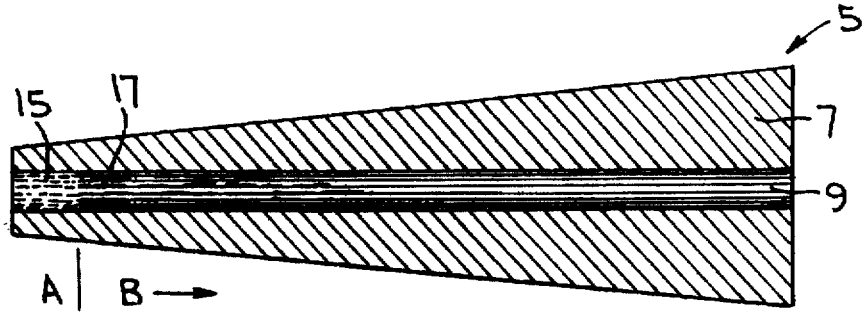
FIG. 1*b* is a longitudinal section of a similar anchor cone as shown in FIG. 1*a* but schematically represents ruptures in the surface layer of the cable and of the boundary layer between cable and anchor body.

FIGS. 1*a* and 1*b* schematically and in section show possible damages as they may arise in carbon-fiber anchors in a cast anchor system. The cast anchor system 1 comprises a steel casing 3 with an axial, inside conical borehole. A matching anchoring system 5 enters the cone and is composed of the graduated anchor body 7 and of the carbon-fiber cables 9 to be retained therein, only one cable being shown for sake of simplicity. The friction at the transition surface 11 between the anchor body 7 and the casing 3 shall be minimized, either by depositing a separation agent on the inside of the casing 3 or by the anchor body 7 being coated, for example, with a teflon foil. This requirement is essential in order to keep the two bodies freely displaceable relative to one another. As a rule, the anchor body 7 is reinforced at the boundary surface by means of webs of glass, carbon or aramide fibers.

When a tension F is applied to the carbon-fiber cables 9, there will be, in general, two possible kinds of damage which are schematically shown in FIGS. 1*a* and 1*b*. FIG. 1*a* shows transverse cracks 13 in the anchor body 7 and these usually arise at the front of the anchor body. Another cause of premature anchoring failure may be the occurrence of a so-called slippage rupture wherein cracks or ruptures 15 or 17, respectively, arise in the boundary layer between cable and anchor filler material. The rupture evolution is such that first cracks 15 arise in the first zone A and then propagate fairly rapidly in the zone B. In both shown cases, that is both in FIG. 1*a* and in FIG. 1*b*, the initial damage arises in the front zone of the cast cone 5, very likely because stress concentration occurs in this zone when the tension F rises.

Figure 2:
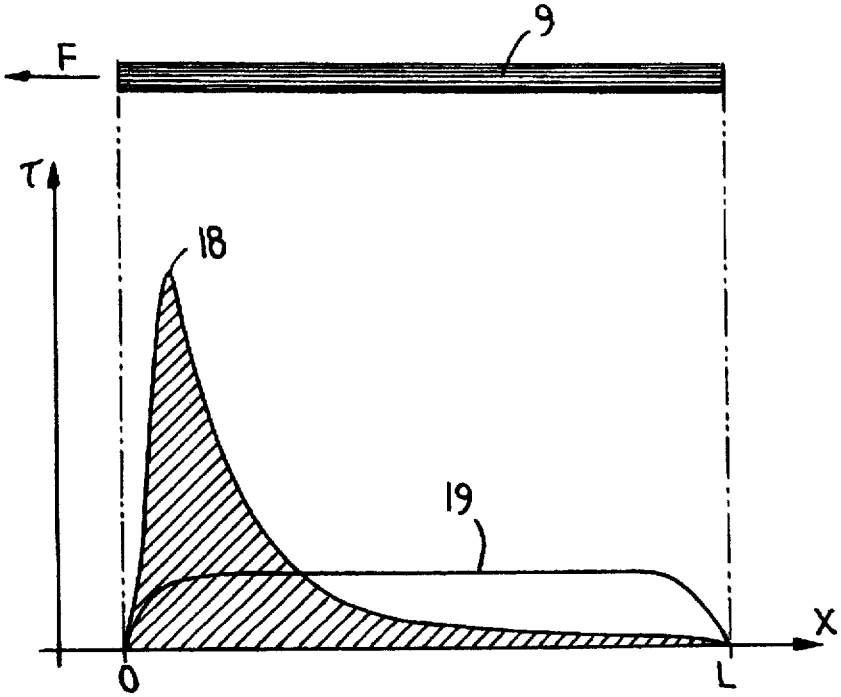
FIG. 2 is a plot of the shear distribution along a tensile element in an anchor body.

Such surmise is reinforced in the light of the stress plot of FIG. 2 showing the shear along the length of the anchor body 7 at the surface of the carbon-fiber cable 9. Curve 18 of FIG. 2 shows the ascertained shear distribution in a conventional, non-graduated cast anchoring system along the surface of an anchored carbon-fiber cable. On the other hand, the curve 19 shows the ideal stress distribution as a result of which the frequency of ruptures/cracks in the front zone's filler material or on the surface of the carbon-fiber cable of the anchoring system would not be relatively higher. To achieve a more or less ideal stress distribution along the surface of a carbon-fiber cable or the carbon-fiber cable bundle, the invention now proposes that the rigidity of the anchor filler material at the front zone of the cast anchoring system shall rise in the direction of the rear. Such a cast anchoring system of the invention is now elucidated below in relation to FIGS. 3 and 4.

Cables are assumed which consist of carbon-fiber reinforced epoxy resin, the cables being manufactured by pultrusion. In this process, fiber rovings, illustratively made by Toray Industries, Japan, type T 700, are unwound from spools and pulled through a bath of epoxy resin. The system Araldite LY 556/HY 917 was selected as the epoxy-resin matrix system. The set of fibers and resin was shaped/drawn with simultaneous gelling of the resin in a hardening form into the desired contour. Using a removal device, the cables are pulled through the hardening oven and then are cut in six-meter lengths. Every seven cables are joined into a bundle and are cast/encapsulated into an anchor cone using a filled epoxy resin. The filling of the anchor cone is implemented by known procedures, for instance by vacuum injection. The anchor filling material used again was an Araldite epoxy-resin system from Ciba-Geigy, containing the resin components CY205/CY208, various quantities of a hardener HY917 and of a flexibilizer DY070 being admixed in a number of experiments. In the unfilled epoxy-resin system, values of Young's modulus of 400 to 800 MPa through 3,500 to 4,300 Mpa were obtained. The fillers used were steel balls, glass beads and aluminum oxide made by Metoxit Co. and of the Alcoa type. Young's modulus for steel or aluminum oxide reach as high as 300,000 MPa.

The purpose of these tests was to shift any rupture at increased tension of the carbon-fiber cables onto the free segment, it being assumed here that theoretically the rupture at the free segment occurs at a tension which is about 94% of the individual tensions of the individual tension elements. A tensile strength up to 3,300 MPa was measured for the above carbon-fiber reinforced epoxy-resin cables.

Figure 3A:
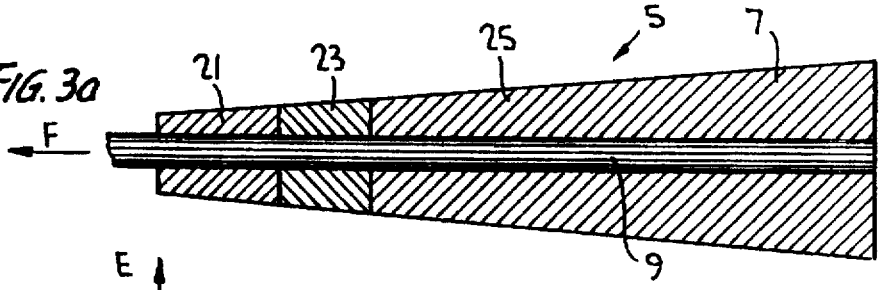
FIGS. 3*a*–3*c* show the effect, on shear distribution on the surface of a tension element, of three rigidity gradations in the anchor body comprising a soft zone at the front anchor portion.

As shown in section in FIG. 3*a*, an anchor body 7 for anchoring the carbon-fiber bundle 9 (shown as a single cable) was used. Three zones 21, 23 and 25 were selected to be of different anchor filling-material rigidities, increasing from front to rear. The anchor matrix selected in the front zone 21 was a flexibilized, i.e., a softened epoxy resin, with a filling degree in the order of magnitude of 3 to 10% (short fibers and other fillers), the selected filler evincing a comparatively small grain size. The Young's modulus so obtained and depending on the selected mixture and the used, softened epoxy-resin matrix, was in the order of about 500 MPa.

The anchor matrix in the adjoining zone 23 was an epoxy resin softened only insignificantly, the filling degree being in the order of 10–20%, with a grain size of the aluminum oxide used being 14–28 mesh. The Young's modulus so obtained and depending on the selected epoxy resin and selected filler quantity was between 5,000 and 15,000 MPa.

The rear zone 25 of the cast body was formed by an unsoftened epoxy-resin matrix which per se already evinced a Young's modulus in the order of 4,000 MPa. In this zone, the filling degree was between 20 and 85%, coarse aluminum oxide being used. To achieve a very high degree of filling, relatively low-viscosity resin Araldite F was used for making the epoxy-resin matrix. The Young's modulus achieved in zone 25 was in the order of 70,000 to 300,000 MPa.

Figure 3B:
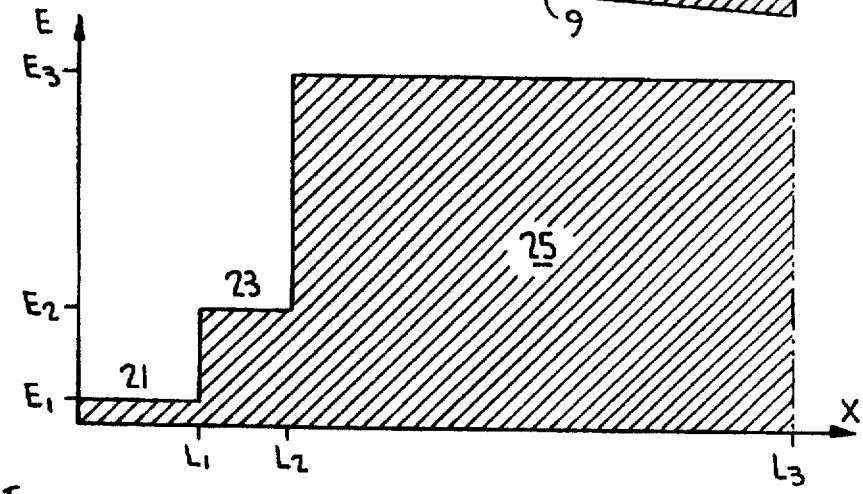

FIG. 3*b* shows the relative magnitudes of the corresponding Young's moduli relative to the total length of the cast body, the increase in rigidity from front zone to rear zone of the anchoring system being shown.

Figure 3C:
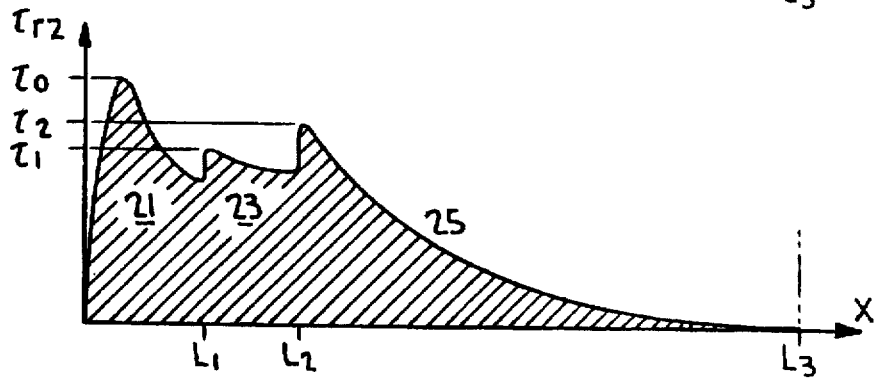

FIG. 3*c* shows the shear $\tau$ as a function of the length of the anchor cone. It is clear by comparison with FIG. 2 that a substantially lower stress-concentration peak is present in the zone 21.

Figure 4A:
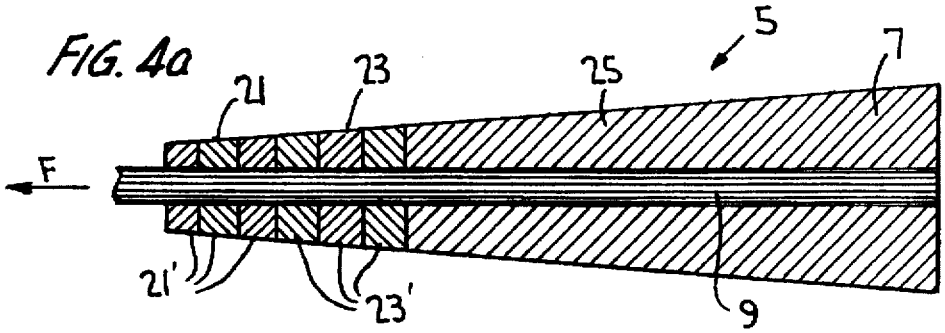
FIGS. 4*a*–4*c* shows the effect of the graduated and related ideal rigidity distribution in the anchoring on the shear distribution at the surface of the tensile element.

FIG. 4*a* again shows an anchor cone 5 wherein, however, a substantially continuous increase in rigidity of the anchoring body from front to rear of the anchor cone is achieved. The front zone 21 of FIG. 3 in this case is formed by three sub-zones 21', the adjoining zones 23 by the three sub-zones 23', whereas the rear zone 25 substantially corresponds to that of FIG. 3.

Figure 4B:
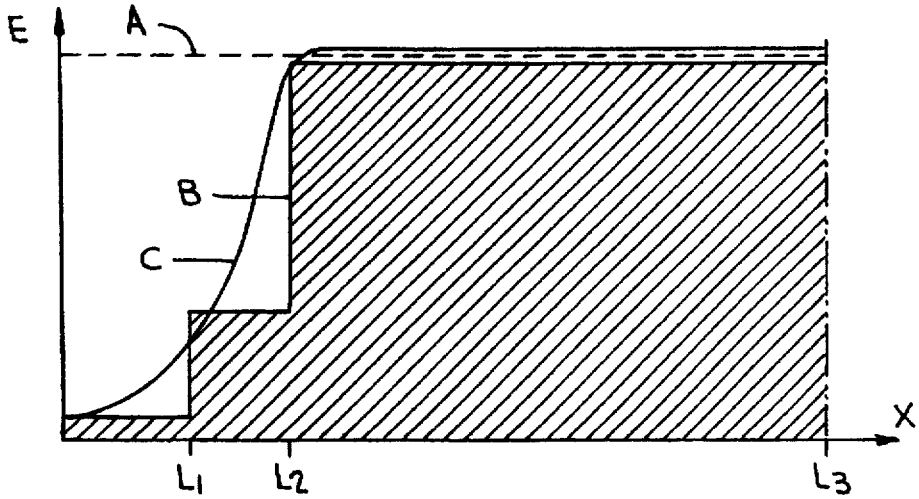

Accordingly, FIG. 4*b* shows a substantially uniform increase in Young's modulus represented by curve C. The step B corresponds to that of FIG. 3*b*, and A represents the case for which Young's modulus, that is the rigidity, is constant along the entire anchor cone, that is the anchor filling material is homogeneous over its entire length.

Figure 4C:
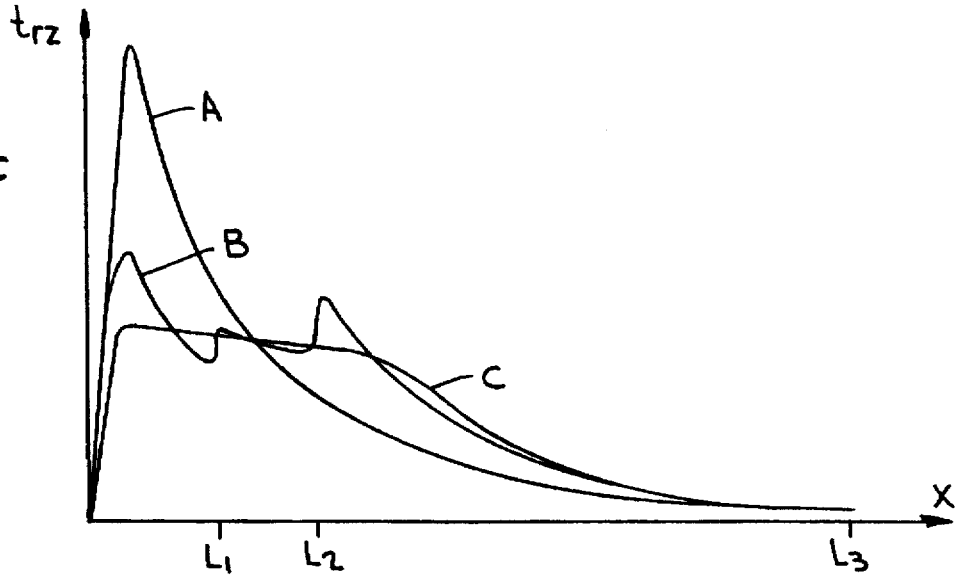

The three cases A, B and C are next shown in FIG. 4*c* in relation to the shear distribution $\tau_{rz}$. In the case of constant rigidity of the anchor body, that is for case A, the stress distribution is the same as shown in FIG. 2 by the curve 18. Curve B corresponds to the shear distribution of FIG. 3*c*, whereas now curve C shows the shear distribution from the anchor-cone design of FIG. 4*a*.

Comparison in particular of curves B and C shows that on account of the more uniform increase of Young's modulus in the zones 21 and 23, significant improvement of the shear distribution hardly can be achieved, and as a result, higher manufacturing cost for the anchor body and anchor cone 7 and 5, respectively, hardly can be justified.

Tension tests on anchoring systems of the invention furthermore have shown that when sub-dividing the anchor zone 5 into three different zones of manufacture of the anchor body 7, a possible rupture of the carbon-fiber cables would already be shifted to the free segment. Therefore, the invention proposes that the anchor body comprise at least two, preferably three to five zones of different rigidities.

Similar results were achieved in that, for example, the front zone 21 was built up with an epoxy resin filled with polymer granulate to evince a relatively low Young's modulus. The rearmost zone 25 on the other hand was filled with a ceramic granulate in order to achieve high rigidity and high resistance to creep. The middle transition zone 23 was filled with a mixture of ceramic and polymeric granules.

Instead of being composed of epoxy-resin systems, the anchor material of course also can be made up of other thermosetting or thermoplastic systems, such as polyurethane or polyester resin materials in particular. The adjustment of rigidity is especially simple in the case of polyurethane resin materials. Basically, however, the softness/hardness can be modified for all thermosetting systems by incorporating softeners, flexibilizers or even elastomeric blocks into the polymer system, whereas on the other hand the rigidity/hardness can be strongly increased by raising the density of cross-linking, for example, by using the so-called Novolac resins.

Similar experiments to those described above furthermore were carried out using pre-manufactured anchor bodies made of thermoplastic or thermosetting polymers and using the same fillers, in particular such as glass, steel and aluminum oxide. Polyether ketone, polymethyl methacrylate, and polycarbonate, that is thermoplastic polymers, were used which evince a comparatively high Young's modulus in the range of about 2,000 to 3,000 MPa. However, in spite of the design of the invention of the cast body, so-called brittling ruptures occurred with increasing strength in the front zone of the anchoring when using polymethyl methacrylate and polycarbonate.

It can be observed generally with respect to selecting the material, the fillers and the filling degree in the anchor body and with respect to designing the rigidity distribution, that the radial pressures on the cable surface caused by the incurred tensile forces must be sufficient to raise the interlaminary shear strength of the cables and to preclude a so-called cable slip-out from the cast body. On the other hand, however, the rigidity in the anchor body can not be excessively high because then the radial pressure arising from tension will be completely absorbed by the anchor body, not transmitted to the cable surface. It was found advantageous in the various tests that the rigidity values increase by a factor of about 100 from the so-called soft front zone to the rear zone. Accordingly, rigidity values of about 2–3 GPa were measured in the front zone whereas they rose up to 300 GPa in the rear zone.

Further optimization to tear-out resistance by the anchored carbon-fiber cables is possible by changing the dimensions and the shape of the anchor cone. Illustratively, it is advantageous that the aperture angle of the anchor cone be as small as possible because a slender cone leads to advantageous stressing. However, the angle is limited downward by the admissible cone slippage, i.e., by the maximum shifting under tensile load. If the cone radius is too small, the radial stresses will be too slight and the anchor cone might be pulled out of the anchor casing or the casing might break up in the front zone.

Further optimization is possible by selecting the radius at the entry of the carbon-fiber cables into the anchor cone to be only slightly larger than the radius of the carbon-fiber bundle.

It was found moreover that the surface of the anchor body in the linear conical anchor casing need not be correspondingly linear conical but instead can be curving in a tapered manner toward the entry. However, such curved design of the cast body does not affect the finding of the invention that the rigidity of the anchor filling material, i.e., in the cast body, must increase from front to rear.

When encapsulating the carbon-fiber cables in the anchor casing and simultaneously generating differential rigidities, another problem was encountered, namely that as a rule the fillers are already fed jointly with the carbon-fiber cables into the cone before this cone is filled under vacuum with the anchor matrix, i.e., with the epoxy resin. In this way it is next to impossible to achieve a lesser degree of filling in the front than in the rear zone because, on account of filling the cone with filler material prior to resin injection, generally only uniform distribution of the filler in the anchor body is produced.

Accordingly, the invention proposes further that the filler(s) be differentially clad/coated with binder prior to the filling procedure. It was found especially advantageous to coat the fillers using a so-called fluid-bed granulator or a shaker mixer or a biaxial mixer employing a coating means such as, for example, the resin used as binder. In this procedure, aluminum oxide or a mineral granulate is made to swirl by the rotation of a fluid-bed tool and is most finely homogenized. Then, the coating material evincing a substantially lower Young's modulus than the granulate, being 10 to 1,000 times lower, is fed into the mixing vessel. As mentioned above, the coating material can be the binder resin system being used as the anchor filler matrix. However, obviously other materials evincing a lesser Young's modulus can also be used. As a rule, the coating material is fed in the form of a dry or bonding powder or in solution into the mixing vessel. Depending on the dwell-time in the fluid-bed granulator or in an agitation mixer or biaxial mixer, a more or less substantial wall thickness is obtained whereby the binder resin system clads the filler. Depending on the materials used, the clad/coated filler granulate is subsequently dried in an oven or hardened.

Figure 5:
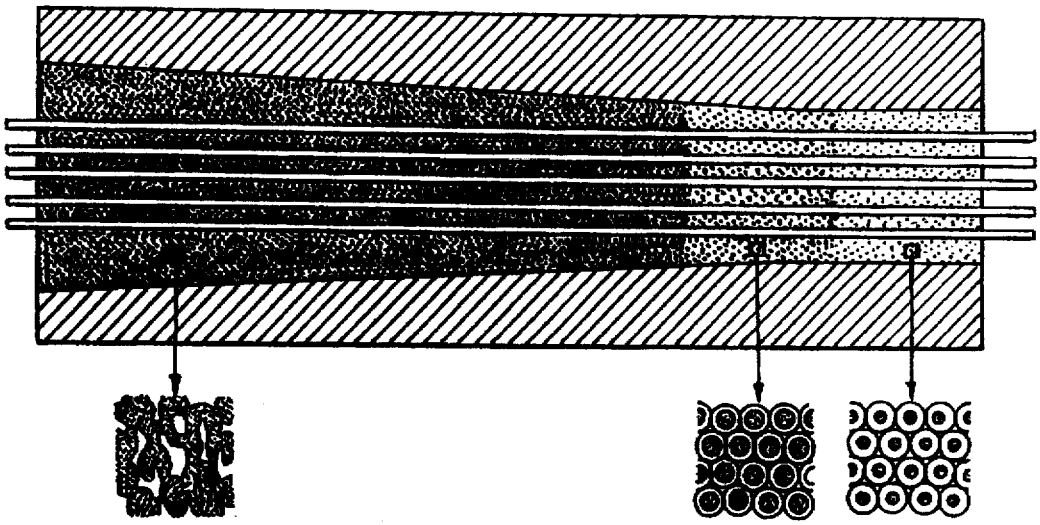
FIG. 5 is a longitudinal section of an anchor body of the invention wherein its filler was clad/coated differentially with a binder. The filler is coated more thickly at the front than at the rear.

The fillers with different cladding/coating thicknesses so made then can be fed into the vertical anchor cone shown in FIG. 5, practically unclad/uncoated fillers being filled into the rear zone whereas fillers with high wall thicknesses of binder resin are filled into the cone's front zone. When injecting the binder resin or anchor matrix, the danger henceforth is absent that the filler might be distributed homogeneously throughout the entire anchor cone, rather, as demanded by the invention, the degree of filling in the front zone is substantially less than in the rear zone. Thereby, again as required by the invention, the rigidity is less at the front and substantially higher at the rear. The anchor body shown in FIG. 5, therefore, is made of a so-called gradient material.

The advantage of using coated fillers, for example coated aluminum oxide, is that for instance the sensitive carbon-fiber cables used cannot be locally damaged in the front zone. Moreover, there are no local "micro-stress" concentrations.

The above discussion of the invention, inclusive of FIGS. 1 through 5, obviously is not to be a final description because the design of the anchoring system can be arbitrarily modified, varied and changed. Illustratively, the above described invention is not restricted to the use of carbon-fiber cables but instead can also be used for anchor systems where other tensile elements are being used, for example steel cables, tensile elements made of aramide fibers, fiber glass tensile strands, etc. Again, the manufacture of the anchor filler material can be arbitrary, and the most diverse materials can be used in making the anchor body. Practically, all thermosetting polymer systems are especially well suited for the purpose, however, and obviously thermoplastic casting materials also can be used. Especially well suited fillers are rubber, steel, mineral fillers, aluminum oxide, and further all fillers used conventionally in this respect in polymer casting systems.

It is essential in the invention that the rigidity in the anchor body of an anchoring system increase from the front to the rear (gradient material) in order that the shear distribution be as uniform as possible along the surfaces of the tension elements, that is, to prevent a strong stress peak in the front zone of the cone.

Again, it is essential to the invention that the rigidity variation of the anchor body (gradient material) be implemented by coating the fillers.

It is claimed:

1. A conical anchoring system to anchor at least one loaded stressed tension element comprising:

a conical anchor body having an exterior surface, a reduced diameter front end and an increased diameter rear end; and an anchor casing defining an interior conical wall;

wherein the anchor casing receives the conical anchor body, said exterior surface freely and slidingly contacting said interior conical wall;

wherein the conical anchor body retains said at least one tension element; and wherein said conical anchor body is made of a gradient material having a rigidity that increases from said front end to said rear end.

2. The system claimed in claim 1, wherein said gradient material comprises a binder matrix and at least one filler, and the rigidity of said gradient material is variable depending upon a factor selected from the group consisting of degree of filling, geometry of the at least one filler, rigidity of the at least one filler, and hardness of the at least one filler.

3. The system claimed in claim 2, wherein said binder matrix comprises a thermosetting polymer system including at least one material selected from the group consisting of plasticizers, flexibilizers, softeners, and elastomer blocks; and wherein said at least one material is proportioned such that said front end is less rigid than said rear end.

4. The system claimed in claim 1, wherein the rigidity increases by a factor ranging from about 20 to about 300 from the front end to the rear end.

5. The system claimed in claim 1, wherein said conical anchor body has an angle of aperture in a range of from about 5 degrees to about 15 degrees.

6. The system claimed in claim 1 further comprising an anchor aperture, defined by the conical anchor body, that has a radius;

a radius defined by said at least one tension element; and an entry in the anchor casing for said at least one tension element;

wherein the difference, at the entry, between said radius of said anchor aperture and said radius of said at least one tension element is about 0.5 mm to about 15 mm.

7. The system claimed in claim 1 wherein the at least one tension element comprises at least one carbon-fiber cable having a binder matrix therein.

8. The system claimed in claim 2, wherein said at least one filler is selected from the group consisting of steel, quartz, glass, rubber, and aluminum oxide; and wherein said at least one filler is provided in a form selected from the group consisting of scrap, sand, balls, fibers, and granulates.

9. The system claimed in claim 1 further comprising in the conical anchor body at least two zones located sequentially from the front end to the rear end such that rigidity of a zone closer to said front end is greater than rigidity of a next adjacent zone that is closer to said rear end.

10. A method for manufacturing a conical anchoring system according to claim 1 comprising providing said anchor casing defining an interior conical wall, coating said interior conical wall with a separation agent, inserting said at least one tension element into the anchor casing, filling said anchor casing with the gradient material to provide said conical anchor body, said filling of said gradient material being carried out in such a manner to increase incrementally rigidity in said conical anchor body such that the rigidity increases from the front end to the rear end.

11. The method of claim 10 wherein, before filling said anchor casing, at least one filler is incorporated in said gradient material, said at least one filler having a binder disposed thereon in such a manner that filler is provided that has a weak binder thickness and filler is provided having a strong binder thickness, wherein filling of said anchor casing is performed initially with said filler having a weak binder thickness, said weak binder thickness facilitating providing the front end with a first rigidity, and wherein subsequent filling of said anchor casing is with said filler having a strong binder thickness to provide the rear end with a higher rigidity than said first rigidity of said front end.

12. The method of claim 11 wherein said binder is disposed on said at least one filler by fluid-bed coating.

13. The method of claim 11 wherein said binder is disposed on said at least one filler by means of a machine selected from the group consisting of a fluid-bed coating granulator, an agitation mixer, and a biaxial mixer.

14. The method of claim 11, wherein said at least one filler comprises aluminum oxide particles and said binder comprises an epoxy-resin system.

* * * * *